US005403124A

United States Patent [19]

Kocaman et al.

[11] Patent Number: 5,403,124

[45] Date of Patent: Apr. 4, 1995

[54] SEMISUBMERSIBLE VESSEL FOR TRANSPORTING AND INSTALLING HEAVY DECK SECTIONS OFFSHORE USING QUICK DROP BALLAST SYSTEM

[75] Inventors: Alparslan Kocaman, Houston; Trevor R. J. Mills, Katy, both of Tex.

[73] Assignee: McDermott International, Inc., New Orleans, La.

[21] Appl. No.: 96,246

[22] Filed: Jul. 26, 1993

[51] Int. Cl.[6] ..... E02B 17/00

[52] U.S. Cl. ..... 405/209; 405/204

[58] Field of Search ..... 405/195.1, 209, 204, 405/198, 196, 203

[56] References Cited

U.S. PATENT DOCUMENTS

| | | | |
|---|---|---|---|
| 2,907,172 | 10/1959 | Crake | 405/209 |
| 3,078,680 | 2/1963 | Wepsala | 405/209 |
| 4,848,967 | 7/1989 | Weyler | 405/209 X |
| 4,973,200 | 11/1990 | Kaldenbach | 405/209 X |
| 5,219,451 | 6/1993 | Datta et al. | 405/209 X |

FOREIGN PATENT DOCUMENTS

| | | | |
|---|---|---|---|
| 1214760 | 11/1959 | France | 405/209 |
| 2008652 | 6/1979 | United Kingdom | 405/209 |
| 2022662 | 12/1979 | United Kingdom | 405/209 |

*Primary Examiner*—Dennis L. Taylor

*Attorney, Agent, or Firm*—Robert J. Edwards; Michael L. Hoelter

[57] ABSTRACT

A method and apparatus for transporting and installing a deck of an offshore platform onto a substructure without requiring heavy lift cranes. The towing vessel or semisubmersible vessel is configured with a cutout or opening therein that surrounds the substructure onto which the platform is to be placed. The platform is transported in an elevated position upon the semisubmersible vessel and it spans across this opening such that once the semisubmersible vessel is properly positioned (i.e. the elevated platform being positioned over and in alignment with the substructure), the semisubmersible vessel is rapidly ballasted thereby transferring the platform onto the substructure.

13 Claims, 6 Drawing Sheets

SEMISUBMERSIBLE VESSEL FOR TRANSPORTING AND INSTALLING HEAVY DECK SECTIONS OFFSHORE USING QUICK DROP BALLAST SYSTEM

FIELD OF THE INVENTION

This invention pertains to the construction of offshore platforms in general and more particularly to a manner of installing a full sized deck upon a substructure without requiring heavy-lift cranes.

BACKGROUND OF THE INVENTION

As is well known, it is much easier and less expensive to construct a large offshore structure on land and tow it to the site for subsequent installation than it is to construct the structure at sea. Because of this, every attempt is made to decrease the amount of offshore work that may be needed in an effort to minimize the cost of the structure. Regardless of these efforts, however, a certain amount of offshore work will still be required in each case.

In the past, when the deck of a large offshore platform was to be installed, it was often found desirable to build the deck as one large component and install it fully assembled by lifting it from the tow barge and placing it upon the substructure. Unfortunately, as the decks became larger and heavier, there were fewer heavy-lift cranes that could handle such a load. Should the deck became too large or too heavy, it was divided into smaller components that were then each individually lifted into place. This prolonged the installation process since multiple lifts were now required and, once installed, the various equipment upon the different components had to be inter-connected and tested, thereby necessitating a large amount of offshore work.

An alternate method to dividing the deck into smaller components, was to build the deck as a complete unit on shore and then skid this oversized deck onto a relatively narrow barge. The barge would then be transported to the installation site where it would be maneuvered between the upright supports of the substructure (thus the need for a narrow barge and for a wide gap between the upright supports of the substructure). Once in place, the barge would be selectively ballasted causing it to float lower in the water thereby enabling the deck to come to rest upon these upright supports of the substructure. Afterwards, the barge would be moved out from under the deck and de-ballasted. Unfortunately, this method necessitates a specially designed substructure with a large open area in its central region near the waterline in order to accept the barge. Normally, such a method is used only for decks which are too heavy to lift in one piece with available heavy-lift cranes. This method also requires a barge that has sufficient beam (width) to provide stability against roll whenever the deck is supported upon the barge. However, to acquire such stability, a wide barge is needed which necessitates an even wider opening in the center of the structure onto which the deck is to be placed which, in turn, results in a longer deck span between the supports of the substructure. Thus, the structural efficiency of both the deck and the substructure is reduced which results in this method only becoming practical for very wide decks and for substructures with reduced deck loads thereon.

Additionally, the manner of ballasting the vessel prior to transferring the deck onto the substructure posed problems. These arose because such ballasting had to occur rather quickly, almost instantaneously, while the deck was properly located and aligned with respect to the substructure. Any sudden wave or wind force could cause such alignment to go astray or the vessel's heave could cause damage to the deck.

It is thus an object of this invention to provide a manner of installing decks upon offshore platforms without requiring the need for heavy-lift cranes or the like. Another object of this invention is to provide an installation method for decks without having to divide the deck into smaller components. Still another object of this invention is to allow selection of a transport vessel of sufficient beam to provide adequate stability against roll. Yet another object of this invention is the ability to install the deck upon a variety of different substructures, there being no need for special configurations thereof. A further object of this invention is to provide a means of rapidly ballasting the vessel during the transfer operation such that the transfer rapidly occurs thereby minimizing both potential mis-alignment and damage to the deck. These and other objects and advantages of this invention will become obvious upon further investigation.

SUMMARY OF THE INVENTION

What is disclosed is an apparatus for transporting and installing a deck of an offshore platform onto a substructure in a marine environment. It consists of a semisubmersible vessel having two or more submerged pontoons that support a deck elevated above the waterline. The deck of the semisubmersible vessel is configured with an opening therein sized to fit partially around the substructure. A skidway assembly is secured to the deck of the semisubmersible vessel for supporting the deck of the offshore platform across the opening. An anchoring assembly moors and maintains the semisubmersible vessel in a pre-selected position partially around the substructure so that the deck of an offshore platform is located above and in alignment with the substructure. A ballasting assembly rapidly lowers the vessel thereby transferring the deck onto the substructure. This ballasting assembly incorporates individual pressurized compartments in the pontoons which are filled with water for ballast purposes. Control means selectively control the flow of water into each of the pressurized compartments.

DETAILED DESCRIPTION OF THE DRAWINGS

Figure 1:
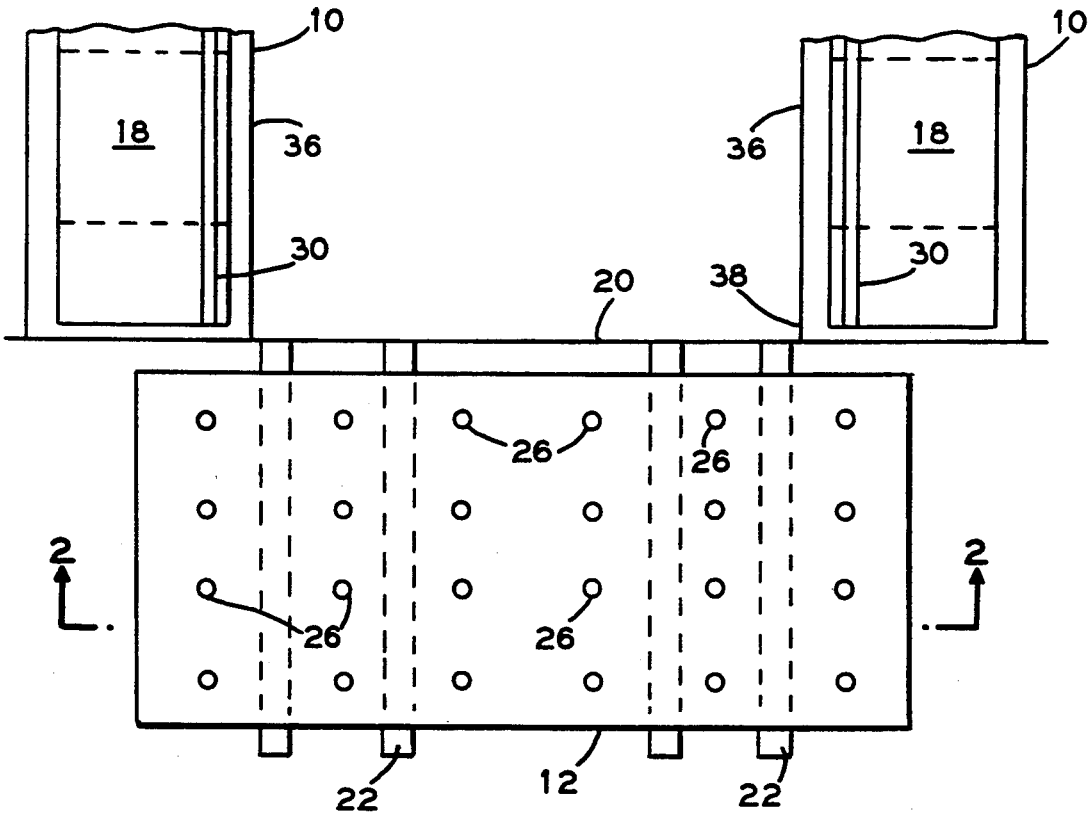
FIG. 1 is a pictorial plan view, partially cut away, illustrating the deck prior to being loaded upon the adjacent semisubmersible vessel.
Figure 2:
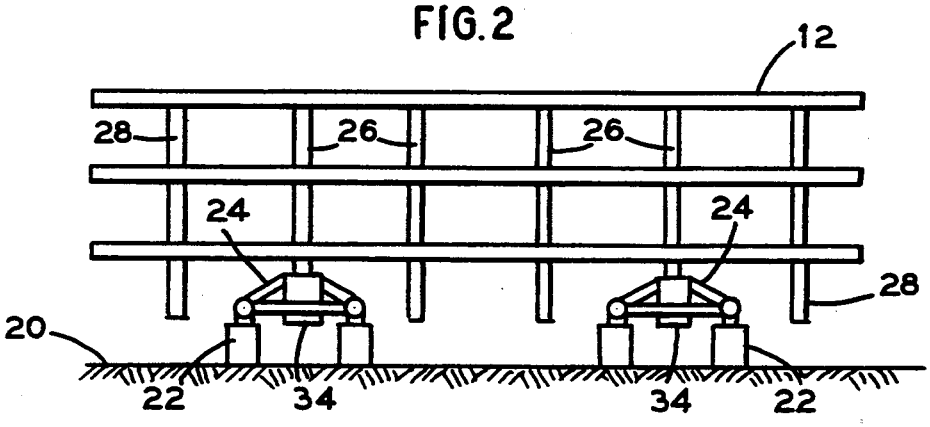
FIG. 2 is a sectional view, taken along lines 2—2 of FIG. 1, illustrating the deck's land support mechanism prior to being loaded upon the semisubmersible vessel.
Figure 3:
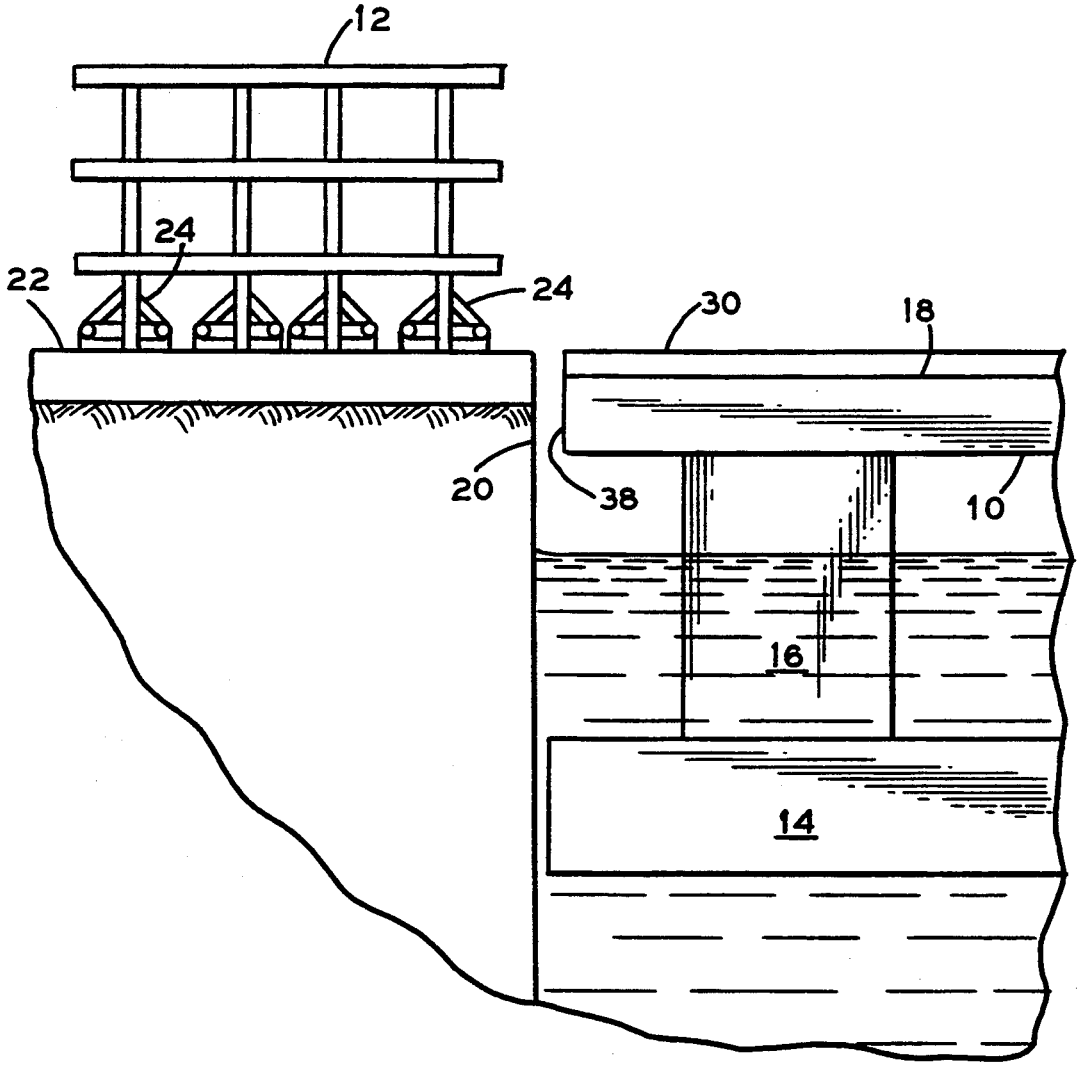
FIG. 3 is a side pictorial view, partially cut away, illustrating the deck prior to being loaded upon the semisubmersible vessel.

Referring initially to FIGS. 1-3, there is shown the opening of semisubmersible vessel 10 and deck 12 of an offshore platform which is to be loaded upon vessel 10 and transported to an offshore construction site.

Vessel 10 is generally a semisubmersible vessel having a plurality of underwater pontoons 14 upon which upright columns 16 and deck 18 are supported. Pontoons 14 are selectively ballasted (such as with water) so that deck 18 of vessel 10 can be moved into alignment with bulkhead 20. In this fashion, deck 12 can be skidded onto vessel 10 for subsequent transportation. Because of the size of pontoons 14 and columns 16, semisubmersible vessel 10 is less subject to pitch and yaw as are conventional barges. Additionally, pontoons 14 provide a high degree of stability to vessel 10 since they are less subject to wave and wind forces.

Deck 12 is initially constructed, on land, upon elevated loadout ways 22 near bulkhead 20. These elevated loadout ways 22 support special loadout trusses 24 which, in turn, support the various interior legs 26 of deck 12. Furthermore, due to the elevated construction of deck 12, oppositely spaced transportation trusses 28 are also elevated above bulkhead 20. Additionally, skidways 30 on deck 18 of vessel 10 are positioned in alignment with the bottom of transportation trusses 28. Thus, when deck 12 is moved or loaded upon vessel 10, such as by means not shown, transportation trusses 28 engage skidways 30 so as to support deck 12 upon vessel 10.

Essentially, the load of deck 12 is transferred from loadout ways 22 located on land to skidways 30 located on vessel 10. Transportation trusses 28 and skidways 30 evenly distribute the weight of deck 12 upon vessel 10 so that vessel 10 can be made seaworthy (i.e. does not have too great a pitch or lean). Additionally, skidway 30 supports deck 12 at the elevation required for mating with offshore substructure 32.

A set of shock absorbing devices or bearing plates 34 are secured to the underneath side of interior legs 26. These shock absorbing devices act as shock absorbers when deck 12 is set down upon offshore substructure 32.

Figure 4:
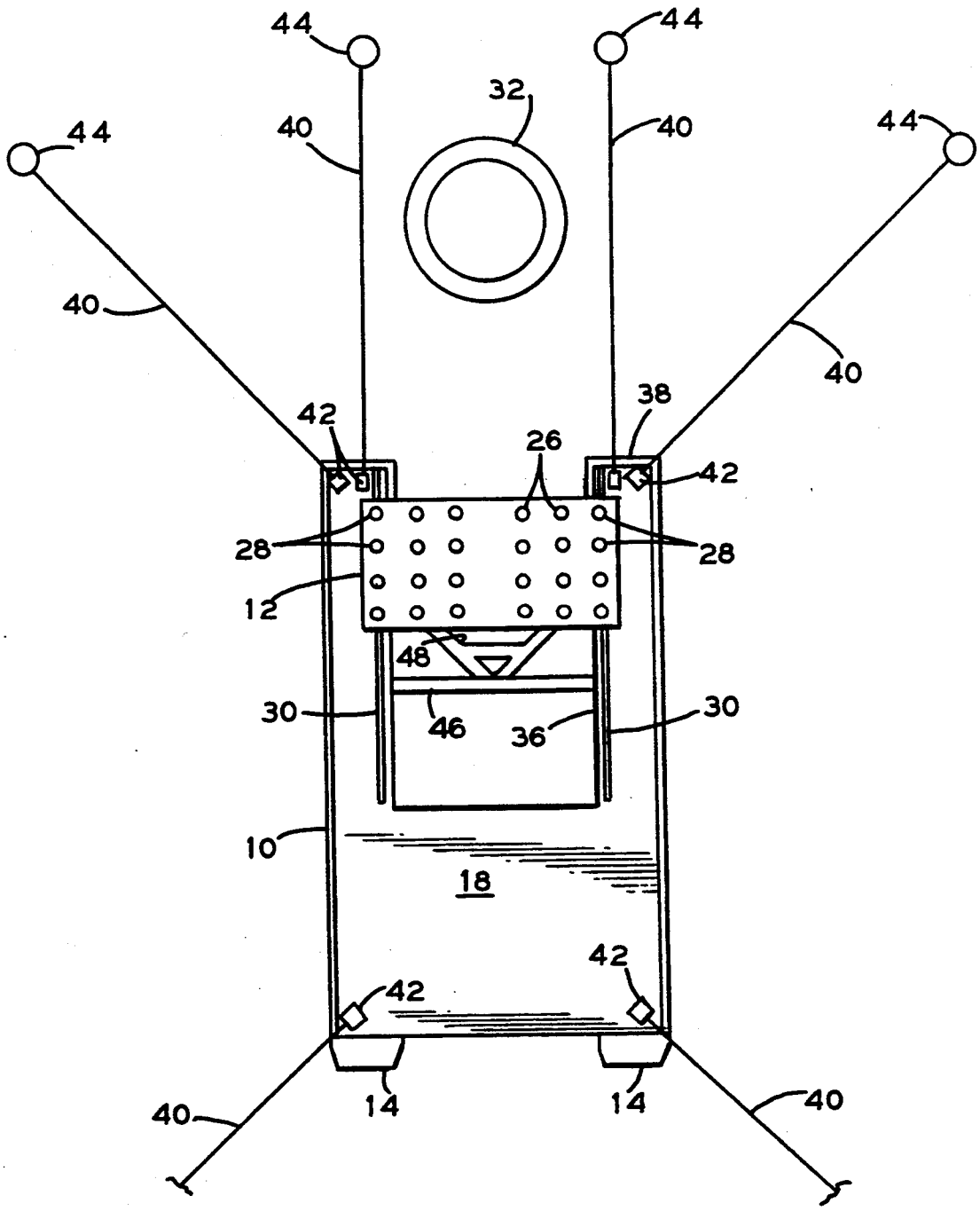
FIG. 4 is a pictorial plan view of the semisubmersible vessel and the supported deck structure as it approaches the substructure in a marine environment.
Figure 5:
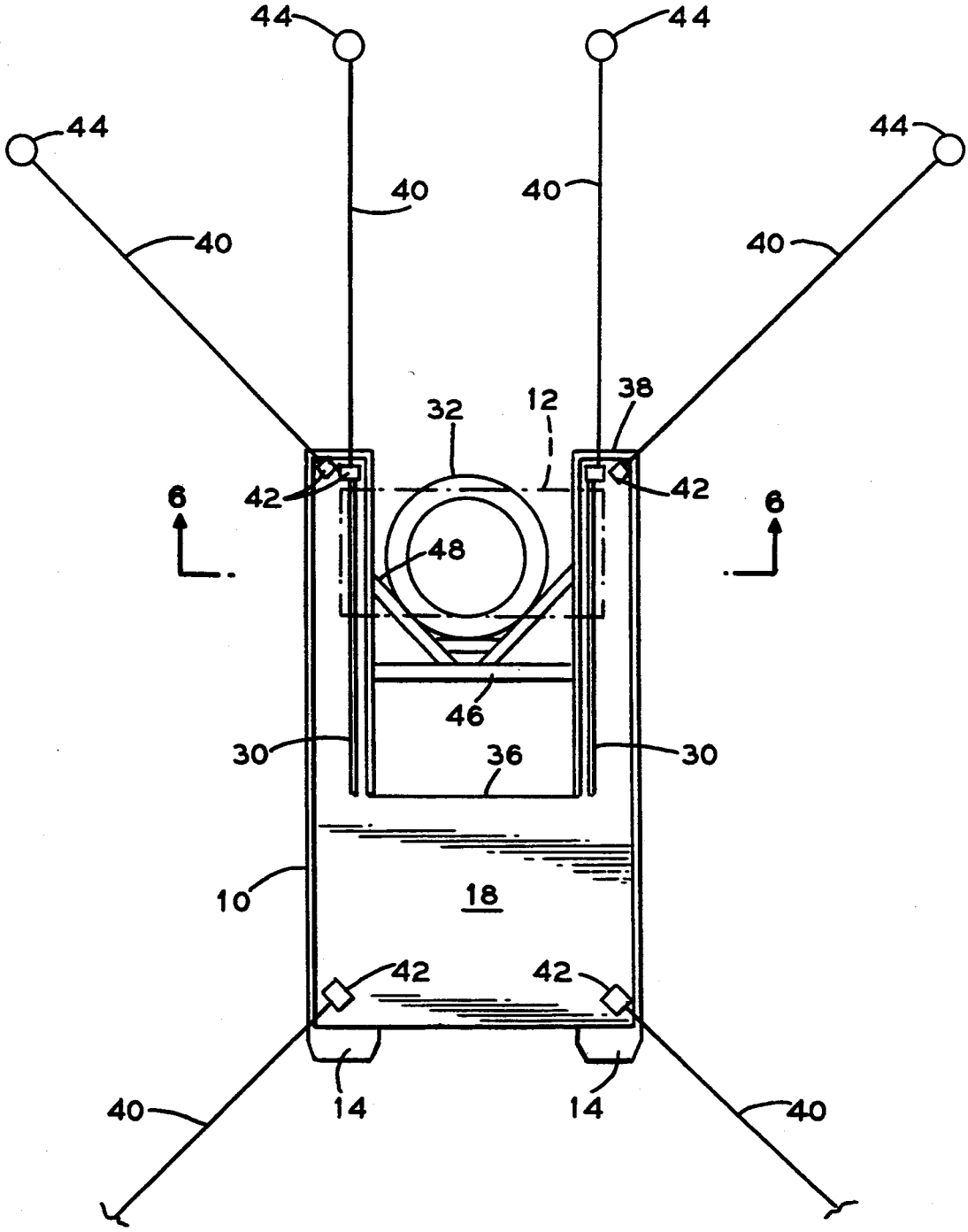
FIG. 5 is a pictorial plan view, with the supported deck removed for clarity, of the semisubmersible vessel being properly located with respect to the substructure.

Referring now to FIGS. 4 and 5, vessel 10 is shown both approaching offshore substructure 32 and partially enclosing substructure 32. As can be seen in these figures, deck 18 of vessel 10 has an opening 36 therein sized to accommodate offshore substructure 32. Deck 12 spans across opening 36 while it is supported upon transportation trusses 28 and skidways 30 of vessel 10. As can be imagined, it is the stern end region 38 of vessel 10 which is moored adjacent bulkhead 20 during the loading operation.

When vessel 10 approaches substructure 32, mooring lines 40 are extended from winches 42 on vessel 10 to previously installed spring buoys 44. These mooring lines 40 and winches 42 help align vessel 10 with respect to substructure 32 and they aid in restraining vessel 10 in place. Mooring lines also prevent vessel 10 from coming loose and possibly damaging substructure 32.

As better seen in FIG. 5, vessel 10 is constructed with bumper structure 46 across opening 36. Bumper structure 46 further insures the proper alignment of vessel 10 with respect to substructure 32 prior to the transfer of deck 12 to substructure 32. In fact, deck 12 is positioned upon vessel 10 in a preset location with respect to bumper structure 46 so that when bumper structure 46 engages substructure 32, deck 12 is in alignment with substructure 32. This bumper structure 46 is shown as being constructed having a "V" shaped opening 48 therein, but other configurations are equally likely, such as a multiple sided opening resembling part of an octagon, hexagon, pentagon or the like.

Figure 6:
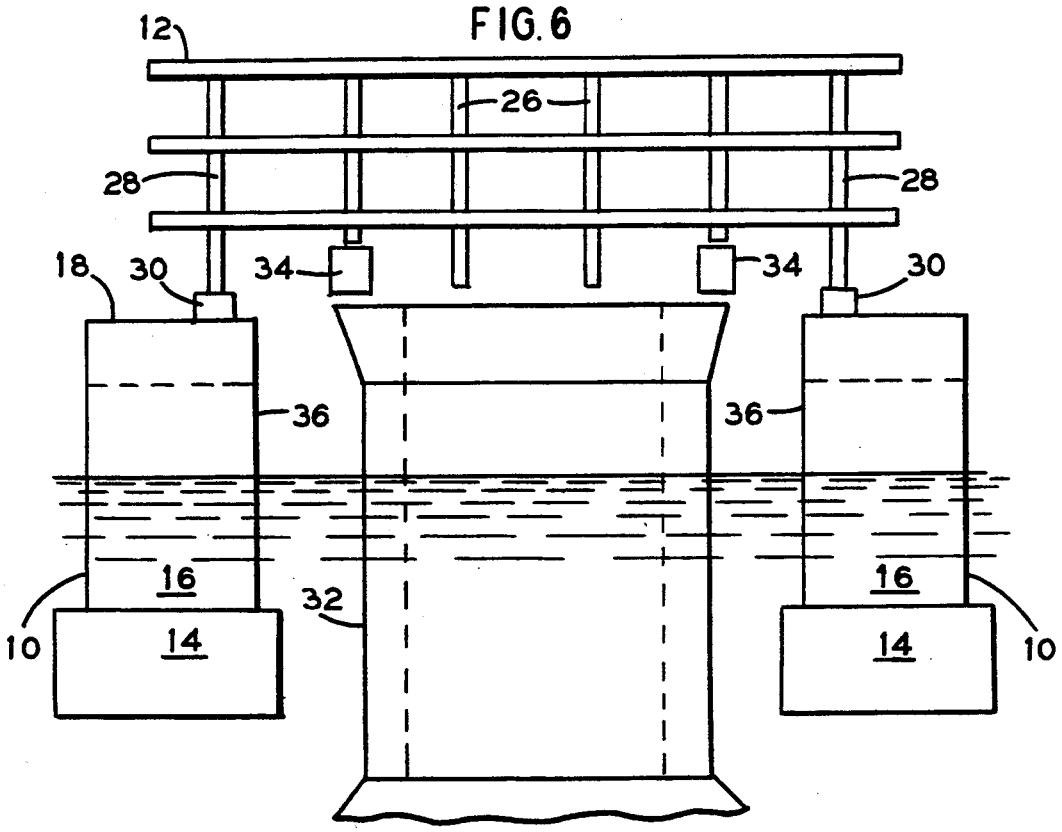
FIG. 6 is a sectional view, taken along lines 6—6 of FIG. 5, prior to the transfer of the deck onto the substructure.

FIG. 6 illustrates the arrangement of vessel 10 and deck 12 with respect to substructure 32 prior to the transfer of deck 12 to substructure 32. Shock absorbing devices 34 are checked to insure that they are positioned directly over their corresponding supports on substructure 32 before vessel 10 is ballasted.

Upon satisfaction that vessel 10 and deck 12 are properly positioned, ballasting system 50 (FIG. 7) is activated so as to rapidly flood pontoons 14 of vessel 10. Generally, there is more than one such ballasting system 50 in each pontoon 14 and each pontoon 14 is also compartmentalized so that different compartments (or different pontoons 14) can be flooded to different depths depending upon the load on vessel 10. This helps insure the stability of vessel 10 during transportation and loadout and maintains a level orientation of deck 18.

Figure 7:
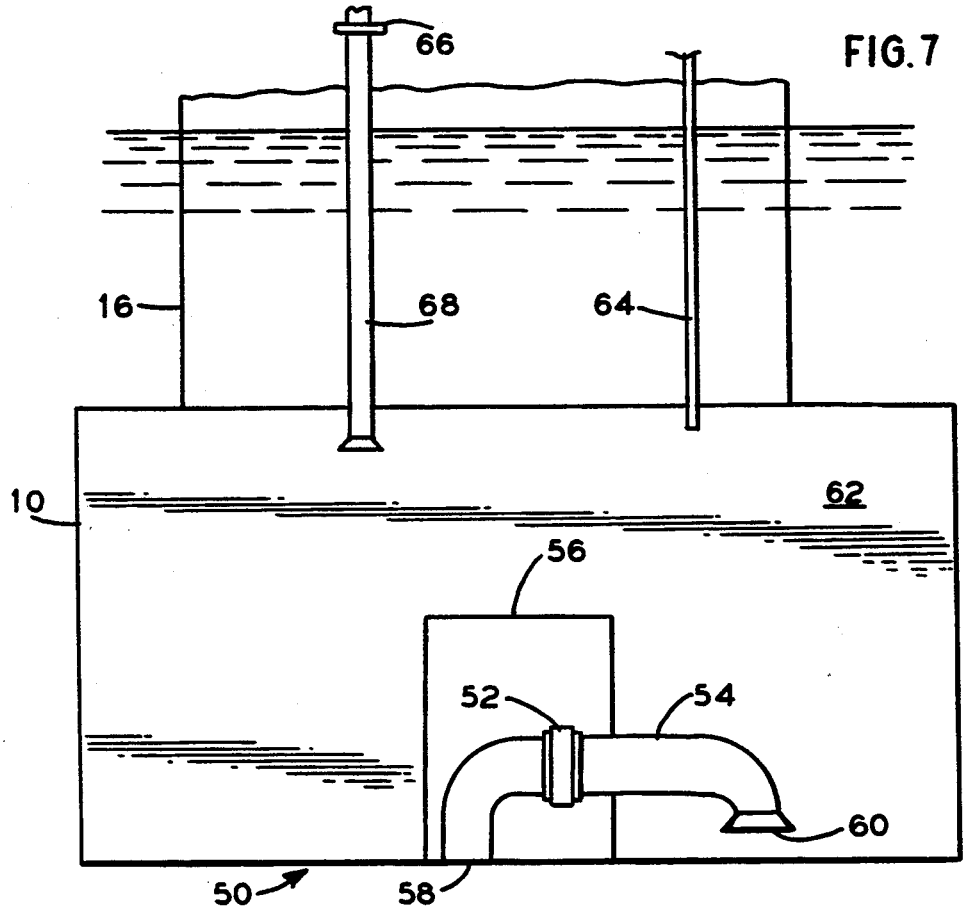
FIG. 7 is a pictorial view of the ballasting assembly found in the semisubmersible vessel.

As shown in FIG. 7, ballasting system 50 incorporates seachest valve 52 in piping 54 which is enclosed within access chamber 56. Piping 54 incorporates inlet 58 in the bottom of pontoon 14 for the passage of seawater therethrough and outlet 60 which opens into compartment 62. Normally, seachest valve 52 is in the closed position, but it is opened as needed.

Before ballasting system 50 is used, and after vessel 10 is on location, the air in surrounding compartment 62 is compressed using compressors on board vessel 10. This compressed air is forced through compression pipe 64, thereby pressurizing compartment 62, while air vent valve 66 in vent pipe 68 is kept closed. When the pressure within compartment 62 and the seawater pressure in inlet 58 equalize, seachest valve 52 is opened while still retaining air vent valve 66 closed. Due to such equalization, no seawater flows through piping 54 or seachest valve 52 into compartment 62 and thus vessel 10 remains stationary.

However, as soon as it is decided to ballast vessel 10 so as to transfer deck 12 onto substructure 32, air vent valve 66 (there may be more than one such valve 66 per compartment 62) is quickly opened which permits the pressurized air in compartment 62 to escape via vent pipe 68 and the seawater to enter via inlet 58. Thus, rapid ballasting is effected which causes vessel 10 to quickly sink thereby permitting deck 12 to be transferred to and come to rest upon substructure. Such rapid ballasting will continue to occur until air vent valves 66 are closed and equalization occurs again.

Figure 8:
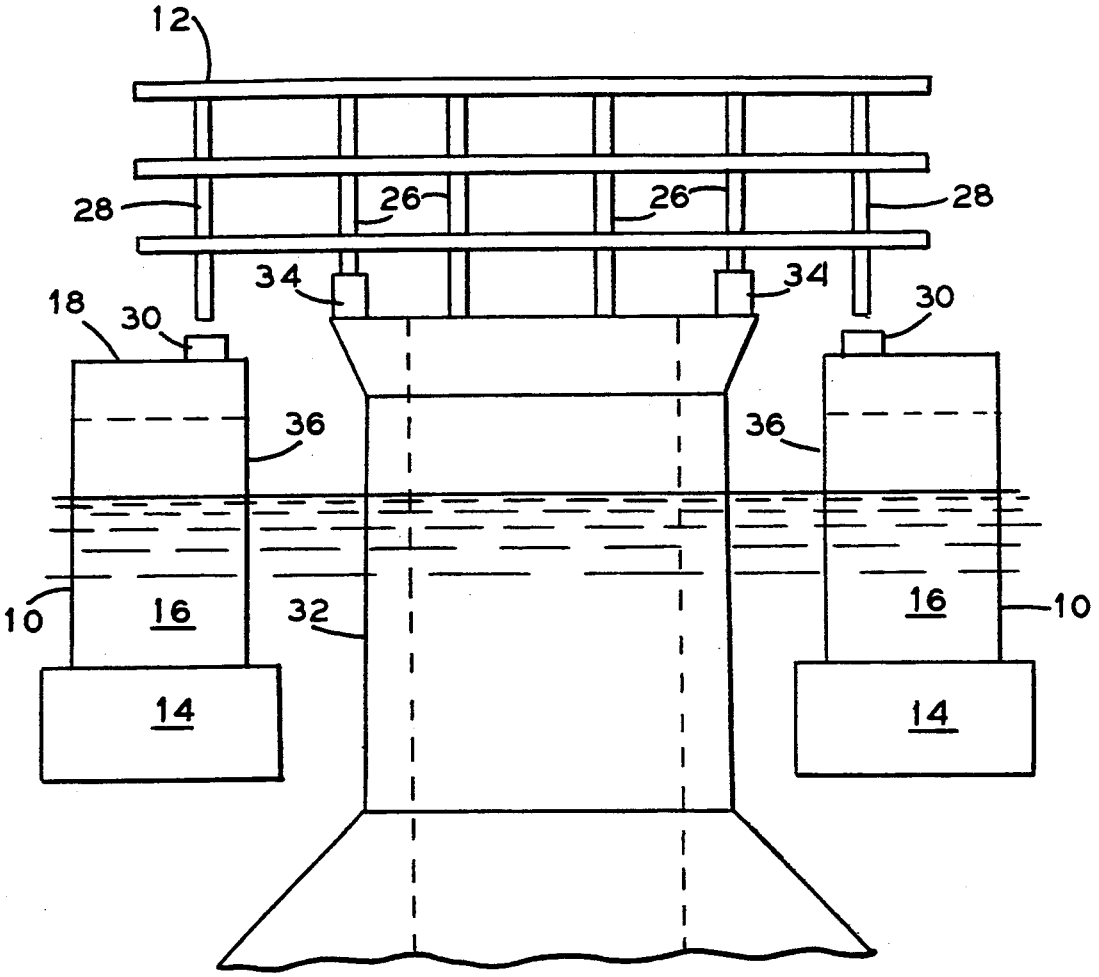
FIG. 8 is a sectional view, similar to that of FIG. 6, but after the transfer of the deck onto the substructure.

FIG. 8 shows vessel 10 after it has been ballasted and after deck 12 has been transferred onto substructure 32. As illustrated, shock absorbing device 34 and interior legs 26 now engage substructure 32 while transportation truss 28 no longer engages skidway 30 on vessel 10. After vessel 10 is removed from substructure 32, legs 26 and shock absorbing device 34 are more securely attached to substructure 32 thereby finally securing deck 12 in place. Once vessel 10 is removed, is may be de-ballasted by closing air vent valve 66 and forcing pressurized air into compartment 62 via compression pipe 64. This will force water through seachest valve 52 and out inlet 58. Afterwards, when the desired degree of buoyancy is achieved, seachest valve 52 is closed so that no more seawater is allowed to enter compartment 62.

Additionally, after deck 12 is no longer in service and is to be removed, the reverse operation can be accomplished to lift deck 12 off substructure 32 for subsequent disposal.

One advantage of vessel 10 is its great width which provides stability or resistance against rollover due to waves or wind even though vessel 10 may be heavily loaded. Additionally, because vessel 10 is a semisubmersible vessel, it is less influenced by wind or wave forces. Furthermore, by using pressurized air in the quick drop ballasting system 50, the setdown operation proceeds faster than would occur with a transport barge or a floating crane. Also, during such setdown operation, the rate of ballasting can be quickly controlled by adjusting air vent valves 66 so as to conform as needed to current conditions. This is important in order to avoid damaging deck 12 due to the heave of vessel 10. Additionally, since the rate of ballasting is high, the time required to ballast is low thereby requiring a shorter "weather window" for implementation than heretofore required.

What is claimed is:

1. An apparatus for transporting and installing an offshore platform onto a substructure in a marine environment comprising:

(a) a semisubmersible vessel having two or more submerged pontoons;

(b) a plurality of individually pressurable compartments within each said pontoon, each said compartment coupled to a sealable passageway extending to the outside of the vessel for the passage of water therethrough;

(c) a deck supported by said pontoons above the waterline, said deck having an opening sized to fit partially around the substructure, said deck also supporting the offshore platform which spans across said opening;

(d) anchoring means for mooring and maintaining said vessel in a pre-selected position partially around the substructure and for positioning the offshore platform above and in alignment with the substructure;

(e) ballasting means in each said compartment for ballasting or lowering said vessel with respect to the waterline thereby transferring the offshore platform onto the substructure, said ballasting means comprising air pressurization and venting means coupled to each said compartment for selectively pressurizing and venting said compartments thereby selectively filling and draining said compartment of water; and, (f) control means for selectively controlling the flow of water through said sealable passageway and into said compartments.

2. The apparatus as set forth in claim 1 wherein said control means comprise a seachest valve which is normally closed but which is opened upon the pressurization of each said compartment.

3. The apparatus as set forth in claim 2 further comprising bumper means located within said opening for engaging the substructure and for aligning said vessel with respect to the substructure.

4. The apparatus as set forth in claim 3 wherein said bumper means is constructed and arranged so as to partially surround the substructure.

5. The apparatus as set forth in claim 4 further comprising shock absorbing means located intermediate the deck of the offshore platform and the substructure for absorbing the shock of transferring the deck of the offshore platform onto the substructure.

6. The apparatus as set forth in claim 5 wherein said anchoring means comprise winch means located upon said vessel for properly positioning said vessel with respect to the substructure.

7. The apparatus as set forth in claim 6 wherein said opening in said deck is "U" shaped.

8. The apparatus as set forth in claim 7 wherein said opening is located in the stern end region of said vessel.

9. A method of transporting and installing an offshore platform onto a substructure in a marine environment comprising the steps of:

(a) loading the platform onto a semisubmersible vessel having two or more submerged pontoons;

(b) constructing and arranging each said pontoon with a plurality of individually pressurable compartments, each said compartment having access to a sealable passageway extending to the outside of the vessel for the passage of water therethrough;

(c) supporting a deck above the waterline by said pontoons, said deck having an opening sized to fit partially around the substructure, said deck also supporting the offshore platform which spans across said opening;

(d) mooring and maintaining said vessel in a preselected position partially around the substructure via anchoring means for positioning the offshore platform above and in alignment with the substructure;

(e) ballasting or lowering said vessel with respect to the waterline via ballasting means in each said compartment for transferring the offshore platform onto the substructure, said ballasting means comprising air pressurization and venting means coupled to each said compartment for selectively pressurizing and venting said compartments thereby selectively filling and draining said compartment of water; and, (f) selectively controlling the flow of water through said sealable passageway and into said compartments via a control assembly.

10. The method as set forth in claim 9 further comprising the step of installing a seachest valve in said passageway which is normally closed but opening said valve upon the pressurization of said compartment.

11. The method as set forth in claim 10 further comprising the step of locating bumper means within said opening for engaging the substructure and for aligning said vessel with respect to the substructure.

12. The method as set forth in claim 11 further comprising the step of installing a shock absorbing system intermediate the platform and the substructure for absorbing the shock of transferring the platform onto the substructure.

13. The method as set forth in claim 12 further comprising the step of winching said vessel in said preselected position via a winch assembly secured to said vessel.

* * * * *